US006047678A

United States Patent [19]

Kurihara et al.

[11] Patent Number: 6,047,678

[45] **Date of Patent: *Apr. 11, 2000**

[54] MULTI-POSITION OPERATOR-CARRIED FOUR-CYCLE ENGINE

[75] Inventors: Katsumi Kurihara, Nagoya, Japan; Shiro Kawamoto, Chandler, Ariz.; James M. Grayson, Wonder Lake, Ill.

[73] Assignee: Ryobi North America, Inc., Anderson, S.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/614,835

[22] Filed: Mar. 8, 1996

[51] Int. Cl.[7] ..... F01M 1/00

[52] U.S. Cl. ..... 123/196 R; 184/11.1

[58] Field of Search ..... 123/196 R; 184/11.1, 184/11, 2, 13.1

[56] References Cited

U.S. PATENT DOCUMENTS 4,404,936 9/1983 Tatebe et al. .
4,563,986 1/1986 Nakano .
4,969,434 11/1990 Nakagawa .
5,025,762 6/1991 Gohara et al. .
5,149,287 9/1992 Koike .
5,167,207 12/1992 Gohara et al. .
5,176,116 1/1993 Imagawa et al. .
5,213,074 5/1993 Imagawa et al. .
5,241,932 9/1993 Everts ..... 184/11.1
5,421,292 6/1995 Hoffman et al. .
5,447,127 9/1995 Lück et al. .
5,558,549 9/1996 Nakase et al. .
5,606,943 3/1997 Tamba et al. .
5,606,944 3/1997 Kurihara .
5,709,185 1/1998 Aizawa et al. .
5,738,062 4/1998 Everts .

*Primary Examiner*—Noah P. Kamen
*Attorney, Agent, or Firm*—Brooks & Kushman P.C.

[57] ABSTRACT

A power tool having a rotary implement driven by a four-cycle engine. The engine crankcase is vented via an axial passageway which extends through at least one cam shaft axial shaft of the crankshaft and cam shaft. The rotating shaft member inhibits the escape of oil when the engine is running due to centrifugal force.

19 Claims, 4 Drawing Sheets

MULTI-POSITION OPERATOR-CARRIED FOUR-CYCLE ENGINE

TECHNICAL FIELD

This invention relates to four-cycle engines and more particularly to small operator carried four-cycle engines having a crankcase vent for preventing oil loss.

BACKGROUND ART

Operator-carried power tools such as line trimmers, blower/vacuums, chain saws and the like are typically powered by two-cycle internal combustion engines or electric motors. Two-cycle engines have well recognized exhaust emission problems. Until relatively recently, it was believed that four-cycle engines were too heavy and could not be operated through the range of orientations necessary for an operator carried power tool. The present applicant, however, recently introduced a commercially successful four-cycle engine powered line trimmer illustrated in U.S. Pat. Nos. 5,241,932 and 5,421,292 which are incorporated by reference herein.

The Everts '932 patent describes a number of alternative techniques for lubricating the overhead valves and rocker arms oriented in the valve chamber. A sealed lubricant system is described as a number of alternative mist lubrication systems. The mist lubrication systems enable the engine to be inclined very significantly from the vertical orientation. However, when the engine is run in the inverted position for extended periods of time, oil begins to leak from the engine breather.

It is an object of the present invention to increase the length of time an operator carried four-cycle engine can be run in the inverted position before oil begins to leak from the engine breather.

It is a further object of the present invention to provide simple and easy-to-manufacture engine components to block the flow of oil from the crankcase.

These objects and other features and advantages of the present invention will become apparent upon further review of the specification and the drawings.

DISCLOSURE OF THE INVENTION

The invention comprises an operator- carried motor drive power tool and a lightweight four-cycle internal combustion engine for driving a rotary driven implement. The four-cycle engine is mounted on the frame to be carried by the operator in a normal operating position. The four-cycle engine includes a lightweight 'block defining a cylindrical bore and crankcase, an enclosed cam case and a cam bearing. The engine includes conventional piston and connecting rod, reciprocating within the cylindrical bore in cooperation with a crank pin of the crankshaft. The crankshaft is provided with an axial shaft rotatably mounted on the engine block. The crankshaft has an internal axial passageway formed therein with two axial, spaced-apart inlet/outlet ports and a crankshaft web-counterweight affixed to the axial shaft and the crank pin. The web-counterweight has an internal radially extending passageway in communication with one of the inlet/outlet ports of the axial shaft. The second inlet/outlet port of the axial shaft is in communication with the cam case to thereby interconnect the cam case and the crankcase via the crankshaft passageway. When the engine is in operation, the rotating passageway precludes the flow of free oil and large oil droplets from the crankcase to the cam case while allowing oil mist laden air to pass freely therebetween.

BEST MODES FOR CARRYING OUT THE INVENTION

Figure 1:
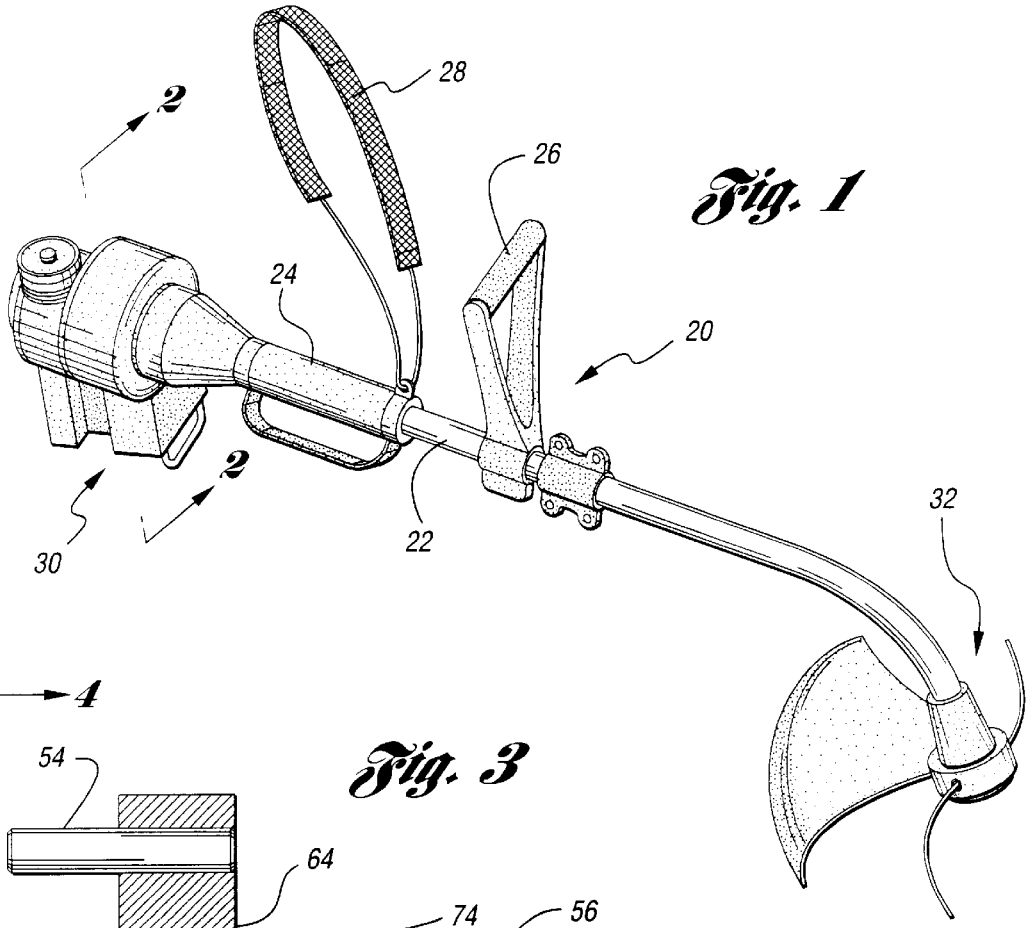
FIG. 1 is a perspective view illustrating a line trimmer of the present invention.

FIG. 1 illustrates a line trimmer 20 made in accordance with the present invention. Line trimmer 20 is used for illustration purposes, and it should be appreciated that other hand held power tools carried by operators, such as chain saws or a blower vacuum, can be made in a similar fashion. Line trimmer 20 has a frame 22 which comprises an elongated aluminum tube. Frame 22 has a pair of handles 24 and 26 to be grasped by the operator during normal use. Strap 28 is placed over the shoulder of the user in a conventional manner in order to more conveniently carry the weight of the line trimmer during use. Attached to one end of the frame generally behind the operator is a four-cycle engine 30. The engine drives a conventional flexible shaft which extends through the center of the tubular frame to drive an implement 32 having a rotary cutting head or the like affixed to the opposite end of the frame. It should be appreciated that in the case of a chain saw or a blower/vacuum, the implement would be a cutting chain or a rotary impeller, respectively.

Figure 2:
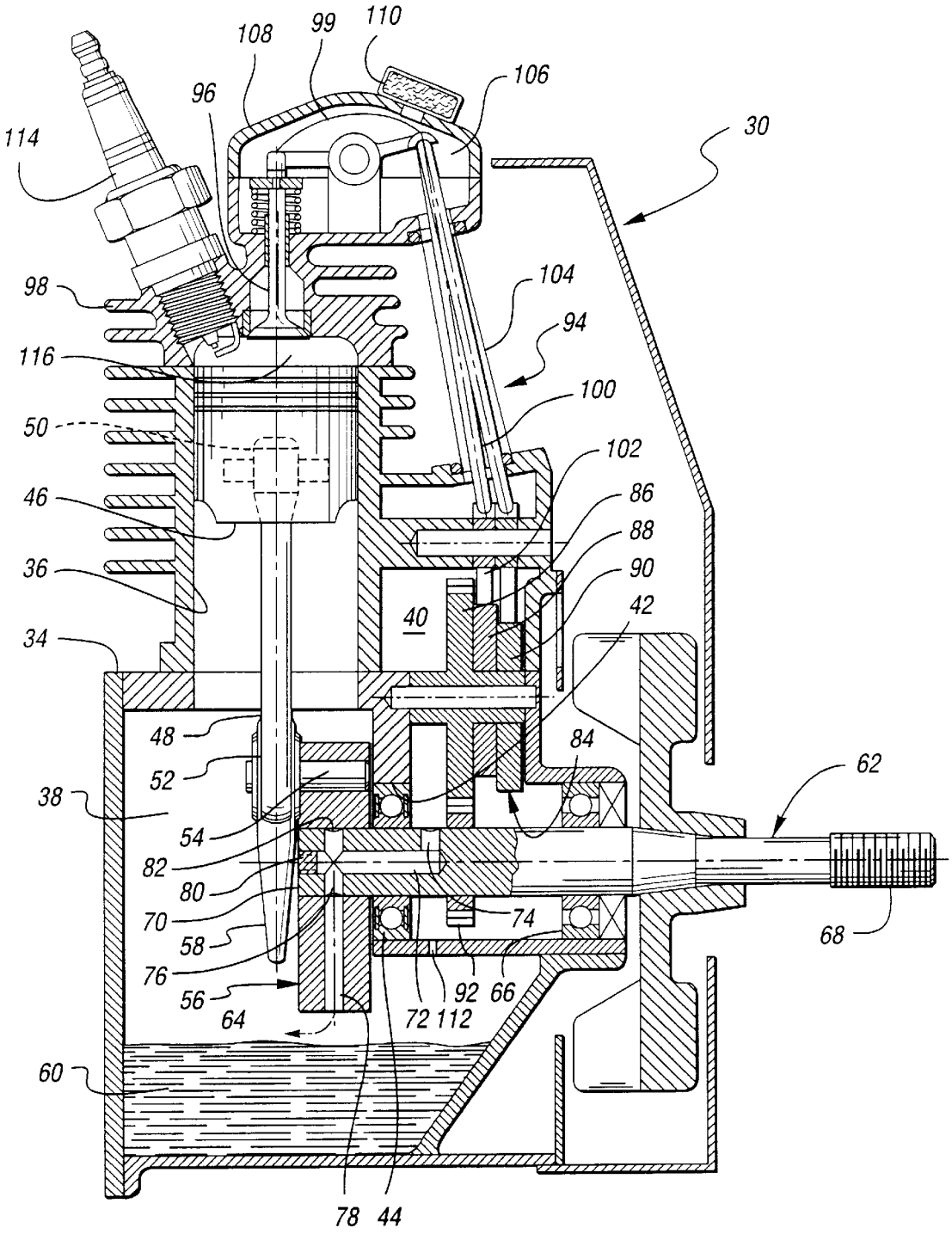
FIG. 2 is a cross-sectional side elevation of the engine of the present invention.

FIG. 2 illustrates a cross-sectional side view of the four-cycle engine 30. Four-cycle engine 30 is made up of a lightweight aluminum engine block 34 having a cylindrical bore 36 formed therein. Engine block 34 defines two internal, substantially-closed cavities; i.e., crankcase 38 and cam case 40. Engine block 34 also defines a bearing journal surface 42 sized to receive an annular bearing such as a sealed roller ball-bearing 44 illustrated in the present embodiment. It should be noted, however, that other types of sealed bearings such as a lead alloy babbitt bearing could be used, although a sealed roller ball-bearing is preferred. Piston 46 and connecting rod 48 form a piston and connecting rod assembly which reciprocates within cylindrical bore 36 in a conventional manner. Connecting rod 48 is provided with a bearing 50 shown in phantom outline, which pivotally cooperates with piston 46, and a bearing 52 which pivotally cooperates with crankpin 54 of crankshaft 56. In the embodiment illustrated, connecting rod 48 is provided with a splasher 58 which intermittently engages oil 60 in the lower region of crankcase 38.

Crankshaft 56 in the preferred embodiment illustrated is made up of three main components; crankpin 54, axial shaft 62 and web-counterweight 64. The web-counterweight 64 is affixed to the axial shaft 62 and crank pin 54 to maintain the crankpin spaced radially apart and parallel to the axis of axial shaft 62. In the embodiment illustrated, crankshaft 56 is of a cantilevered crank design and fabricated from three separate components. It should be appreciated of course that a crankshaft can be formed of a unitary forging as would be the case of a convention U-shaped crankshaft in which the axial shaft would be made up of two portions, one on each side of the crankpin, and in which a pair of web-counterweights would be provided in order to support the crankpin on both sides of the connecting rod 48. The present technology is equally applicable to a non-cantilevered crank U-shaped design of either fabricated or unitary construction.

Axial shaft 62 of crankshaft 56 is generally elongated and is pivotally mounted upon engine bearing 44 and a second axially spaced apart engine bearing 66. Axial shaft 62 has an output end 68 and an input end 70. An axial passage 72 extends through a portion of the axial shaft adjacent input end 70. The axial passage connects to two axial, spaced apart inlet/outlet ports 74 and 76. Inlet/outlet port 74 is positioned in a region of axial shaft 62 which falls within the cam case 40. Inlet/outlet port 76 falls within a region of axial shaft 62 within crankcase 38. Inlet/outlet port 76 communicates with a radial passageway 78 formed within web-counterweight 64 to form a continuous passageway connecting the crankcase 38 to cam case 40 via radial passageway 78, inlet/outlet port 76, axial passage 72 and inlet/outlet path 74.

To facilitate fabrication, axial passageway 72 is formed by drilling a hole in the first end 70 of axial shaft 62 and subsequently plugging the end of the hole using a plug 80. Inlet/outlet ports 74 and 76 are formed by radially drilling holes in axial shaft 62. For convenience in aligning inlet/outlet port 76 with radial passageway 78 in the web-counterweight inlet/outlet port 76 is preferably a through-hole cross drilled through axial shaft 62 which intersects a circumferentially extending groove 82 aligned with inlet/outlet port 76 and radial port 78 so that annular alignment of axial shaft 62 and web-counterweight 64 is not critical.

In operation, splasher 58 will intermittently strike the oil 60 within the crankcase so that air filling the remainder of crankcase 38 will be laden with a fine oil mist. As the piston reciprocates within the bore of the crankcase, the volume accordingly changes as there is a sinusoidal fluctuation in crankcase pressure. This pressure fluctuation causes oil mist laden air to pulse into and out of the passageway extending through crankshaft 56, carrying a fine oil mist into the cam case 40. This oil mist serves to lubricate cam shaft assembly 84, which is made up of a cam drive gear 86 and intake and exhaust cams 88 and 90, respectively. Cam gear 86 is driven by crank gear 92 affixed to axial shaft 62, which rotates the cam shaft assembly 84 at one-half of crankshaft speed. A valve train 94 operatively connected the cam shaft 84 to intake valve 96 and exhaust valve (not shown) located in cylinder head 98. Valve train 94 is an overhead valve rocker arm type design which utilizes a pair of pivotal rocker arm 99 pivotally connects to the cylinder head 98 to cooperate with a cam lobe and one of the valves via a push rod 100 and a cam follower 102.

It should be appreciated that various cam, cam follower and push rod designs can be used for practicing the present invention as for example in the Everts '932 and the Hoffman '292 patents incorporated herein. For example, the preferred embodiment shown in FIG. 2 utilizes a pair of pivotable frog-leg type cam followers 102, but, conventional tappet-type followers could alternatively be used.

Push rods 100 are oriented in a pair of push rod tubes 104 which cooperate with engine block 34 and cylinder head 98. Push rod tubes 104 surround push rods 100 and interconnect cam case 40 and valve chamber 106 allowing oil mist laden air to pass therebetween. Cylinder head 98 is provided with a rocker cover 108 which defines valve chamber 106 therebetween. A breather 110 is affixed to the rocker cover in order to allow air to pass between valve chamber 106 and the atmosphere. Preferably, breather 110 is filled with a fibrous material to entrap oil and to prevent oil escape. Breather 110 enables the pressure in valve chamber 106 to closely approximate atmospheric pressure resulting in the flow of oil mist laden air from the crankcase to the valve chamber 106 via cam case 40 as the pressure within the crankcase varies above and below atmospheric pressure as the piston reciprocates.

The oil laden mist circulating through the cam case 40 and valve chamber 106 will lubricate the moving parts contained therein as the mist condenses on the part surfaces. Mist condensate will form oil droplets which will, via gravity feed, gradually flow back down the push rod tubes 104 into the cam case 40. In order to facilitate the return of oil from the cam case to the crankcase, a small orifice 112 is formed in the lower wall of the engine block to facilitate oil return. It should be appreciated that the effective diameter of orifice 112 must be substantially smaller than the effective diameter of the passageway extending through the crankshaft. Orifice 112 is ideally sized so it is just large enough to enable oil condensate to drip back into the crankcase at the rate which the condensate is formed. Having an orifice larger than necessary would enable oil to leak into the valve case in the event the crankshaft axis is aligned vertically with the crankshaft output end oriented downward.

While it should be appreciated that an engine of the present invention could not run indefinitely in the inverted position as eventually the oil mist would transfer oil from the crankcase to the valve chamber in sufficient quantities to cause leakage, the present invention can substantially increase the length of time an engine utilizing a mist lubrication system can be run in the inverted or inclined state. The design also significantly increasing the range of angular orientations that the engine may be run at in a continuous manner.

Figure 3:
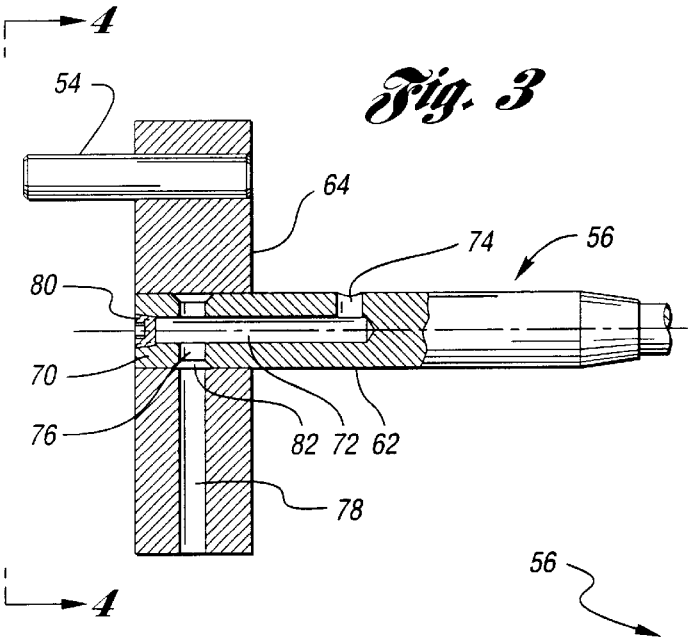
FIG. 3 is an enlarged partially cutaway side elevational view of the crankshaft of the present invention.
Figure 4:
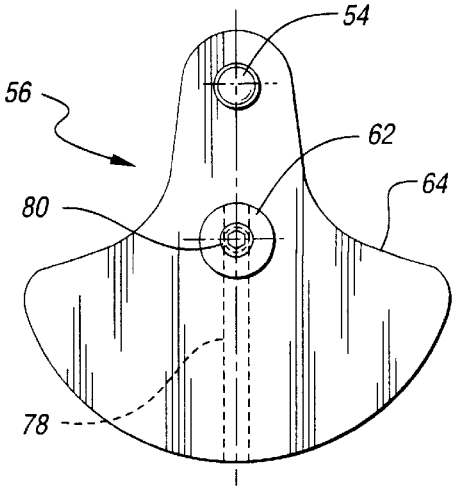
FIG. 4 is an axial end view of the crankshaft taken along the line 4.4 of FIG. 3.

FIGS. 3 and 4 show a crankshaft in greater detail. It should be appreciated that the crankshaft and the passageway formed therethrough is a principal difference between the present invention and the power tool and engine therefor illustrated in the Everts '932 patent. The components of the engine which are not necessarily directly related to the improvement in a mist lubrication system have not been described in detail. The general operation of the engine and the description of conventional engine components, such as sparkplug 114, combustion chamber 116 and other components, such as the intake and exhaust system including the intake port, the exhaust port, carburetor and muffler, are illustrated in the Everts '932 patent.

Figure 5:
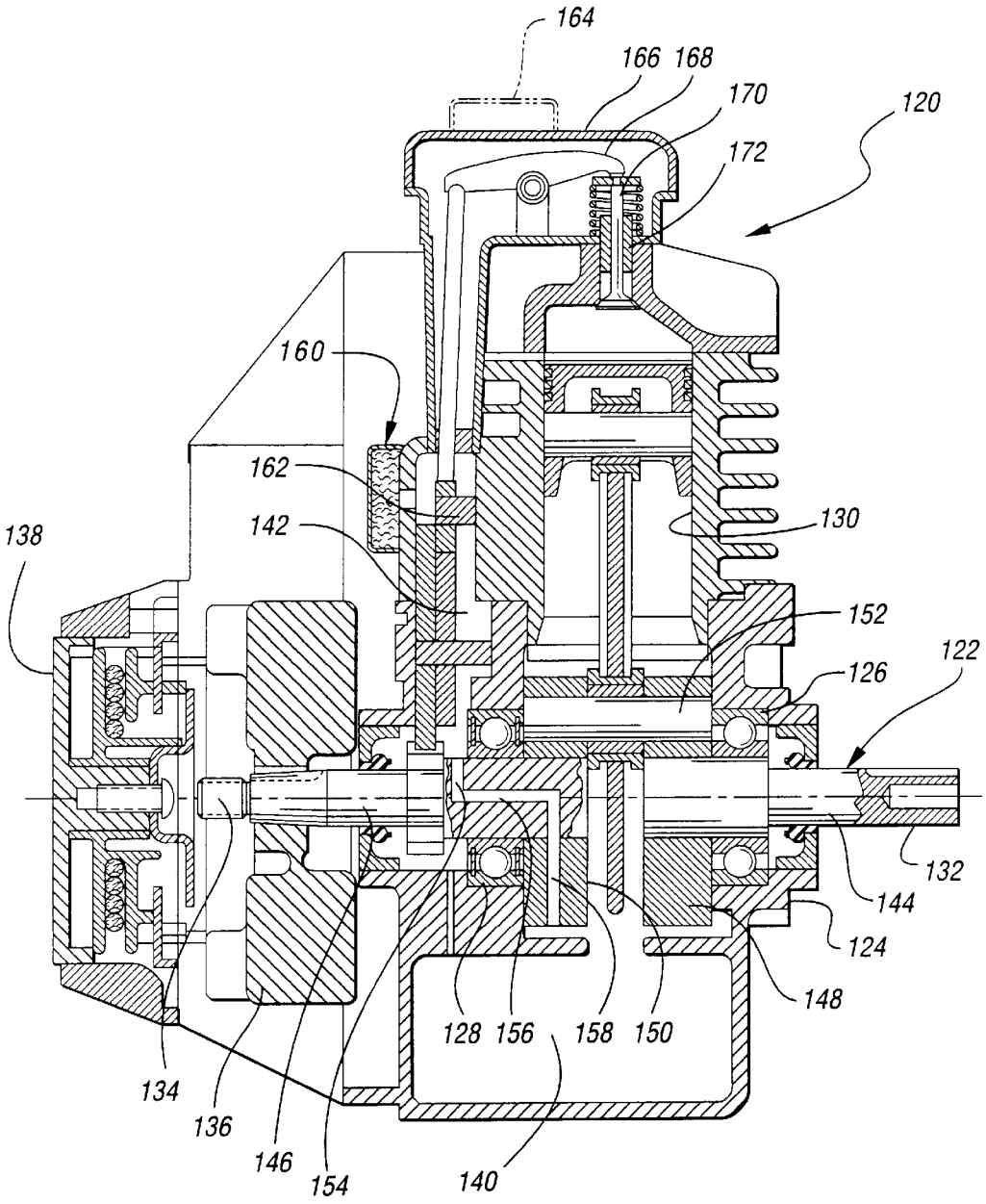
FIG. 5 is a cross-sectional side elevation of an engine illustrating a second embodiment of the invention.

FIG. 5 is an alternative second engine embodiment 120 illustrating an alternative crankshaft construction. Second engine embodiment 120 has a generally U-shaped double ended crankshaft 122 which is pivotally supported relative to engine block 124 by a pair of bearings 126 and 128 oriented on opposite sides of cylinder bore 130. Crankshaft 122 is provided with an output end portion 132 for attachment to a rotary tool or the like and a free end portion 134 which is attached to fly wheel 136 and recoil starter 138.

Crankshaft 122 is provided with an internal passageway 156/158 to accommodate the flow of mist-ladened air between crankcase 140 and cam case 142 as generally described with reference to the four-cycle engine 30 of FIGS. 2–4. Crankshaft 122 is made up of five subcomponents in the embodiment illustrated which are pressed together i.e.; axially-aligned spaced-apart output shaft 144 and accessory shaft 146, first web counterweight 148, second web counterweight 150 and crankpin 152. Second web counterweight 150 is provided with a radial passageway 154 and accessory shaft 146 is provided with a generally "Z" shaped passageway 156 which, in cooperation with the radial passageways 154 and 158 connects crankcase 140 and cam case 142. Passageway 154 is provided with an inlet/outlet port in communication with the crankcase and an inlet/outlet port in communication with cam case as illustrated in FIG. 5 and as described with reference with the first four cycle embodiment 30.

During engine operation, the pressure within crankcase 140 will fluctuate generally sinusoidally. The pressure differential between the crankcase and the cam case will cause air ladened with a fine oil mist to flow into and out through the crankcase of passageway 158. Fine oil mist droplets will be able to flow into the cam case. However, free oil and large droplets will be precluded from flowing through passageway 158 as a result of the centrifugal force caused by the rotation of the crakshaft.

Camcase 142 is vented to atmosphere via a breather. The breather preferably includes a fine fibrous material to trap oil and prevent oil from being discharged from the engine. With reference to FIG. 5, a breather can be placed at one or two locations. Breather 160 is shown affixed to the engine block in the proximity of cam follower 162. Alternatively, breather 164 can be located on rocker cover 166. The breather communicates with the crankcase through passageway 158, but it is isolated from the crankcase as shown, for example, in FIG. 5.

It should be appreciated that locating the breather on the rocker cover causes more mist ladened oil to flow to the rocker arms 168 and valves 170 located in the cylinder head. Locating the breather on the side of the engine will reduce oil flow to the rocker arms and valves relative to the location of breather 164. Which of the two locations selected is a matter of design choice, the amount of oil experimentally determined to be necessary to lubricate the valves and rockers without having excessive oil consumption resulting from oil flowing past valve 170 and valve stem insert 172.

Figure 6:
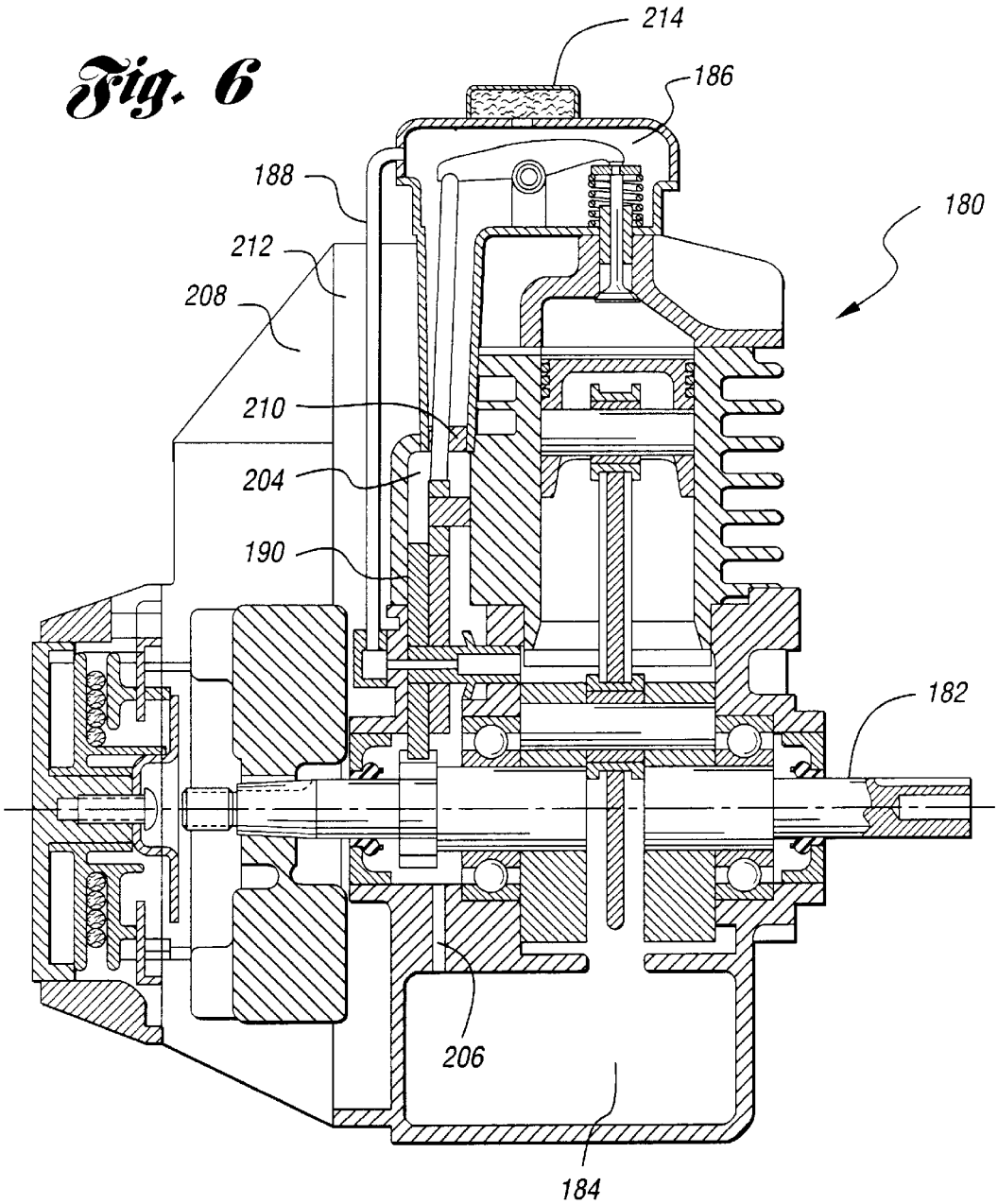
FIG. 6 is a cross-sectional side elevation of an engine illustrating a third embodiment.

FIG. 6 illustrates a third engine embodiment 180. Engine 180 has a generally U-shaped double-ended crankshaft 182 of the same general configuration as crankshaft 122 of the second engine embodiment 120. However, there is no air and mist passageway formed in crankshaft 182. Crankcase 184 is connected to valve chamber 186 via passageway 188 formed by an external tube and internal passageway extending through cam shaft 190.

Figure 7:
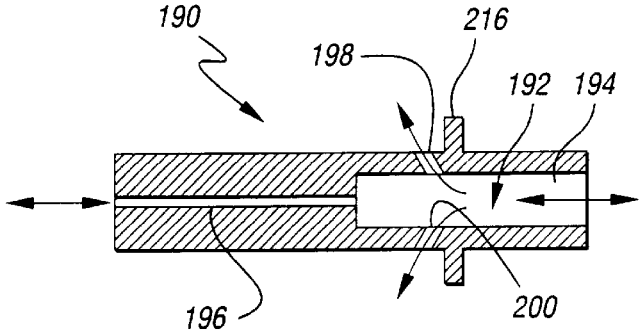
FIG. 7 is an enlarged cross-sectional view of the cam shaft utilized in the third engine embodiment of FIG. 6.

The cam shaft 190 is shown in enlarged cross-sectional elevational view in FIG. 7. The cam shaft 190 has a stepped hole 192 extending axially therethrough. The stepped hole 192 has a large diameter region 194 adjacent the end of cam shaft 190 in communication with crankcase 184. The opposite end of cam shaft 190 is provided with a small diameter hole 196 in communication with passageway 188, which serves to interconnect crankcase 184 and valve chamber 186.

During engine operation, an air ladened mist flows into and out of the axial passageway 192 extending through cam shaft 190. Fine mist droplets pass freely through. Larger oil droplets will be spun by centrifugal force to the outer wall of large diameter passageway section 194 and will be expelled via ports 198 and 200 into cam case 204 where the oil will flow back to crankcase 184 by passing through oil return port 206.

It should be appreciated that valve chamber 186 is connected to cam chamber 204 via push rod tubes 208. A seal 210 extending about push rod 212 substantially isolates valve chamber 186 from cam chamber 204. Oil mist ladened air flowing through hollow cam shaft 190 and passageway 188 will ultimately end up in valve chamber 186 as a result of the location of breather 214. The oil which lubricates the valve train components will flow via gravity down push rod tube 208 leaking past seal 210 back into the cam case 204 and ultimately to crankcase 184.

An oil shedder 216 is preferably formed about the periphery of cam shaft 190 proximate ports 198 and 200. Shedder 216 when rotating serves to prevent oil from flowing back into ports 198 and 200 in the event that cam case 204 becomes flooded with oil when the engine is tipped up on end for an extended period of time. Shedder 216 is optional of course and is not necessary in all applications.

It should be understood, of course, that while the invention herein shown and described constitutes a preferred embodiment of the invention, it is not intended to illustrate all possible variations thereof. Alternative structures may be created by one of ordinary skill in the art without departing from the spirit and scope of the invention described in the following claims.

What is claimed is:

1. A motor driven power tool comprising:

a frame to be carried by an operator;

a rotary driven implement supported by the frame; and a four-cycle internal combustion engine mounted to the frame providing a rotary power source for the rotary driven implement, the engine having:

a lightweight engine block forming a cylindrical bore, an enclosed crankcase in communication with the cylindrical bore, an enclosed cam case and a bearing journal extending between the crank case and the cam case;

a piston reciprocally cooperating within a cylindrical bore;

a connecting rod assembly having a first bearing for pivotally cooperating with the piston, an elongated central region and a second bearing spaced from the first bearing;

a crankshaft having a crankpin cooperating with the connecting rod second bearing, an elongated axial shaft pivotally mounted upon the engine block bearing journal and provided with a driven end, an output end and an internal axial passageway having two axially spaced apart inlet/outlet ports, and a web-counterweight cooperating with the crankpin and the axial shaft maintaining the crankpin and axial shaft in spaced-apart parallel relation, the web-counterweight having a radially extending internal passageway having a first end in communication with one of the inlet/outlet ports in the axial shaft and a second end in communication with the crank case, the other of the inlet/outlet ports of the axial shaft being in communication with the cam case to thereby interconnect the cam case and crank case;

a cylinder head assembly attached to the engine block to define a combustion chamber in cooperation with the cylinder bore and the piston, said cylinder head assembly having overhead intake and exhaust ports, a spark plug hole extending into the combustion chamber and an intake valve, an exhaust valve and a spark plug respectively cooperating with the intake and exhaust ports and spark plug hole;

a cam shaft including cams for sequentially activating the intake and exhaust valves, a cam shaft drive means drivably connecting said crankshaft and said cam shaft for driving said cam shaft at ½ engine speed; and a valve cover attached to the cylinder head to define a valve chamber whereby an oil mist formed by lubricating oil which partially fills the crankcase is free to pass through the passageway in the crankshaft while the engine is running as large oil droplets are precluded from entering the rotating radially extending passageway in the crankshaft web-counterweight as a result of centrifugal force thereby resulting in the engine being operable in a number of orientations without having liquid oil flowing into the valve chamber.

2. The power tool of claim 1 further comprising a breather vent connected to the atmosphere, a passageway extending through said crankshaft between said breather vent and said crankcase, said breather vent thereby being isolated from said crankcase.

3. The power tool of claim 1 wherein said engine block is provided with an oil return port extending between the cam case and the crankcase to enable oil condensate forming in the valve chamber and cam case to return to the crankcase via gravity feed when the engine is being operated in a normal generally vertical position, the oil return port having a substantially smaller effective area than the area of the passageway extending through the crankshaft.

4. The power tool of claim 1 wherein the crankshaft is generally U-shaped with two coaxially-aligned, spaced-apart, axial shaft portions, said web-counterweight having two associated web-counterweight portions interconnected by the crankpin, one of the axial shaft portions associated with one of said web-counterweight portions having an internal passageway formed therein.

5. The power tool of claim 1 further comprising a mist lubricant passageway extending between the cam case and the valve cover which is at least partially formed by the engine block.

6. A lightweight four-cycle internal combustion engine comprising:

a lightweight engine block forming a cylindrical bore, an enclosed crank case in communication with the cylindrical bore, an enclosed cam case and a bearing journal extending between the crank case and the cam case;

a piston reciprocally cooperating within a cylindrical bore;

a connecting rod assembly having a first bearing for pivotally cooperating with the piston, an elongated central region and a second bearing spaced from the first bearing;

a crankshaft having a crankpin cooperating with the connecting rod second bearing, an elongated axial shaft pivotally mounted upon the engine block bearing journal and provided with a driven end, an output end and an internal axial passageway having two axial spaced apart inlet/outlet ports, a web-counterweight cooperating with the crankpin, the axial shaft maintaining the crankpin and axial shaft in spaced apart parallel relation, a web-counterweight having a radially extended internal passageway having a first end in communication with one of the inlet/outlet ports in the axial shaft and a second end in communication with the crankcase, the other of the inlet/outlet ports of the axial shaft being in communication with the cam case to thereby interconnect the cam case and crankcase;

a cylinder head assembly attached to the engine block to define a combustion chamber in cooperation with the cylinder bore and the piston, said cylinder head assembly having overhead intake and exhaust ports, a spark plug hole extending into the combustion chamber and an intake valve, an exhaust valve and a spark plug respectively cooperating with the intake and exhaust ports and spark plug hole;

a cam shaft including cams for sequentially activating the intake and exhaust valves, a cam shaft drive means drivably connecting said crankshaft and said cam shaft for driving said cam shaft at ½ engine speed; and a valve cover attached to the cylinder head to define a valve chamber wherein an oil mist formed by lubricating oil which partially fills the crank case is free to pass through the passageway in the crankshaft while the engine is running as large oil droplets and liquid oil are precluded from entering the rotating radially extending passageway in the crankshaft web-counterweight by centrifugal force whereby the engine is able to be operated in a number of orientations.

7. The engine of claim 6 wherein said engine block is provided with an oil return port extending between the cam case and the crankcase to enable oil condensate forming in the valve chamber and cam case to return to the crank case via gravity feed when the engine is being operated in a normal generally vertical position, the oil return port having a substantially smaller effective area than the area of the passageway extending through the crankshaft.

8. The engine of claim 6 wherein the crankshaft is generally U-shaped and has two coaxially-aligned, spaced-apart, axial shaft portions, said web-counterweight having two associated web-counterweight portions interconnected by the crankpin, one of the axial shaft portions associated with one of said web-counterweight portions having an internal passageway formed therein.

9. The engine of claim 6 further comprising a breather vent connected to the atmosphere a passageway extending through said crankshaft between said breather vent and said crankcase, said breather vent thereby being isolated from said crankcase.

10. The engine of claim 9 wherein the breather vent is affixed to the valve cover interconnecting the valve chamber with the atmosphere.

11. A crankshaft for use in a four-cycle engine provided with a piston connecting rod assembly and an engine block defining a cylindrical bore, a generally enclosed crankcase and an adjacent cam case interconnected by a bearing journal, the crankshaft comprising:

a crankpin cooperating with the connecting rod second bearing;

an elongated axial shaft pivotally mounted on the engine block bearing journal and provided with a driven end, an output end and internal axial passageway having two axial spaced apart inlet/outlet ports; and a web-counterweight cooperating with the crankpin, the axial shaft maintaining the crankpin and axial shaft in spaced apart parallel relation, a web-counterweight having a radially extending internal passageway having a first end in communication with one of the inlet/outlet ports in the axial shaft and a second end in communication with the crank case, the other of the inlet/outlet ports of the axial shaft being in communication with the cam case to thereby interconnect the cam case and crankcase, wherein an oil mist formed by lubricating oil partially fills the crankcase and is free to pass through the passageway in the crankshaft while the engine is running as large oil droplets and liquid oil are precluded from entering the rotating radially extending passageway in the crankshaft web-counterweight as a result of centrifugal force resulting in the engine being operable in a number of orientations.

12. The engine of claim 11 wherein the crankshaft is generally U-shaped and has two coaxially-aligned, spaced-apart axial shaft portions, said web-counterweight having two associated web-counterweight portions interconnected by the crankpin, one of the axial shaft portions associated with one of said web-counterweight portions having an internal passageway formed therein.

13. A lightweight four-cycle internal combustion engine comprising:

a lightweight engine block forming a cylindrical bore and an enclosed crankcase;

a piston reciprocally cooperating within a cylindrical bore;

a connecting rod assembly having a first bearing for pivotally cooperating with the piston, an elongated central region and a second bearing spaced from the first bearing;

a crankshaft having an elongated axial shaft rotatably mounted in the engine block and a radially offset crankpin in cooperation with the connecting rod second bearing;

a cylinder head assembly attached to the engine block to define a combustion chamber in cooperation with the cylinder bore and the piston, said cylinder head assembly having overhead intake and exhaust ports, a spark plug hole extending into the combustion chamber and an intake valve, an exhaust valve and a spark plug respectively cooperating with the intake and exhaust ports and spark plug hole;

a cam shaft including cams for sequentially activating the intake and exhaust valves, a cam shaft drive means drivably connecting said crankshaft and said cam shaft for driving said cam shaft at ½ engine speed, the cam shaft having an axial shaft extending into the crankcase;

a valve cover attached to the cylinder head to define a valve chamber;

a breather vent connecting the engine and to the atmosphere, the breather vent being isolated from the crankcase; and an axial passageway with a rotary, radial port extending at least partially through at least one of the cam shaft and crankshaft axial shafts, the axial passageway enabling air which partially fills the crankcase to pass through the one rotating shaft while precluding oil from passing therethrough due to centrifugal force thereby permitting the engine to be operable in a number of orientations.

14. The engine of claim 13 wherein the crankshaft is generally U-shaped and has two coaxially-aligned, spaced-apart axial shaft portions, said web-counterweight having two associated web-counterweight portions interconnected by the crankpin, one of the axial shaft portions and one of said associated web-counterweight portions having an internal passageway formed therein.

15. The engine of claim 13 further comprising:

a valve cover attached to the cylinder head to define a valve chamber; and a mist lubrication passageway connecting said axial passageway in the cam shaft to the valve chamber;

wherein the mist lubrication passageway is formed at least in part by an external tube extending from the valve chamber to a region of the engine block immediately adjacent the axial passageway formed in the cam shaft.

16. The engine of claim 15 wherein the breather vent is affixed to the valve cover in communication with the valve chamber.

17. The engine of claim 13 wherein the breather vent is affixed to the engine block and in communication with the cam case.

18. A cam shaft for use in a four-cycle engine provided with a piston connecting rod assembly, an engine block defining a cylindrical bore, a generally enclosed crankcase and an adjacent internally-enclosed cam case interconnected by a bearing journal, and a crankshaft rotatably mounted in the engine block and having a crank pin pivotably cooperating with the piston connecting rod assembly within the crankcase, an elongated shaft member extending through the cam case having a crankshaft gear located therein, the cam shaft comprising:

an elongated shaft pivotally supported on the engine block having a portion extending through the cam case and an end portion projecting into the crankcase;

a cam gear affixed to the elongated shaft and cooperating with the crankshaft gear to drive the cam shaft at one-half engine speed;

at least one cam lobe for sequentially activating intake and exhaust valves of the associated engine;

the elongated shaft having an axial passageway extending therethrough and having an axial inlet/outlet opening in communication with the crankcase and a spaced apart inlet/outlet opening oriented outside of the crankcase and at least one port extending through the elongated shaft and intersecting the axial passageway intermediate the inlet/outlet openings to facilitate centrifugal separation of oil from air passing through the axial passageway.

19. A lightweight four-cycle internal combustion engine comprising:

a lightweight engine block forming a cylindrical bore and an enclosed crankcase;

a piston reciprocally cooperating within a cylindrical bore;

a connecting rod assembly having a first bearing pivotally cooperating with the piston, an elongated central region and a second bearing spaced from the first bearing;

a crankshaft having an elongated axial shaft rotatably mounted in the engine block and a radially offset crankpin in cooperation with the connecting rod second bearing;

a cylinder head assembly attached to the engine block to define a combustion chamber in cooperation with the cylinder bore and the piston, said cylinder head assembly having overhead intake and exhaust ports, a spark plug hole extending into the combustion chamber and an intake valve, an exhaust valve and a spark plug respectively cooperating with the intake and exhaust ports and spark plug hole; and a cam shaft including cams for sequentially activating the intake and exhaust valves, a cam shaft drive means drivably connecting said crankshaft and said cam shaft for driving said cam shaft at ½ engine speed, the cam shaft having an axial passageway extending therethrough provided with at least one rotary radial port, wherein said radial port of the cam shaft axial passageway is in communication with the crankcase and wherein the air which partially fills the crankcase is free to pass through the rotating cam shaft as large oil droplets are precluded from passing through the axial passageway in the cam shaft by centrifugal force, thereby permitting the engine to be operable in a number of orientations.

* * * * *